US010779079B1

(12) United States Patent
Yeh et al.

(10) Patent No.: US 10,779,079 B1
(45) Date of Patent: Sep. 15, 2020

(54) SOUND PROPAGATING DEVICE AND LOUDSPEAKER HAVING THE SAME

(71) Applicant: Wistron Corp., New Taipei (TW)

(72) Inventors: Chih-Feng Yeh, New Taipei (TW); Kun Ming Lu, New Taipei (TW); Shao ping Chen, New Taipei (TW)

(73) Assignee: WISTRON CORP., New Taipei (TW)

( * ) Notice: Subject to any disclaimer, the term of this patent is extended or adjusted under 35 U.S.C. 154(b) by 0 days.

(21) Appl. No.: 16/710,236

(22) Filed: Dec. 11, 2019

(30) Foreign Application Priority Data

Sep. 17, 2019 (TW) ..... 108133416 A

(51) Int. Cl.

| | |
|---|---|
| ***H04R 1/02*** | (2006.01) |
| ***H04R 9/06*** | (2006.01) |
| ***H04R 1/34*** | (2006.01) |
| ***H04R 1/28*** | (2006.01) |

(52) U.S. Cl.
CPC ..... *H04R 1/345* (2013.01); *H04R 1/025* (2013.01); *H04R 1/2811* (2013.01)

(58) Field of Classification Search
CPC ..... H04R 1/345; H04R 1/025; H04R 1/2811
See application file for complete search history.

(56) References Cited

U.S. PATENT DOCUMENTS

| | | | | |
|---|---|---|---|---|
| 5,898,138 | A * | 4/1999 | Delgado, Jr. | H04R 1/403 181/152 |
| 2007/0000720 | A1* | 1/2007 | Noro | H04R 1/2834 181/156 |
| 2018/0206031 | A1* | 7/2018 | Turner | H04R 1/46 |
| 2019/0378385 | A1* | 12/2019 | Biggs | G08B 6/00 |
| 2020/0021907 | A1* | 1/2020 | Pinkerton | H04R 1/323 |

* cited by examiner

*Primary Examiner* — Simon King
(74) *Attorney, Agent, or Firm* — Locke Lord LLP; Tim Tingkang Xia, Esq.

(57) ABSTRACT

The disclosure relates to a sound propagating device including a sound-reflecting component, a first baffle plate, a second baffle plate, and a baffle assembly. The sound-reflecting component has a conical surface. The first baffle plate and the second baffle plate are respectively connected to two opposite ends of the baffle assembly. The first baffle plate, the second baffle plate, and the baffle assembly are moveably located on the conical surface. An angle between the first baffle plate and the second baffle plate is changed when at least one of the first baffle plate and the second baffle plate is moved. In addition, the disclosure also relates to a loudspeaker having the sound propagating device.

18 Claims, 13 Drawing Sheets

1'

1"

SOUND PROPAGATING DEVICE AND LOUDSPEAKER HAVING THE SAME

CROSS-REFERENCE TO RELATED APPLICATIONS

This non-provisional application claims priority under 35 U.S.C. § 119(a) on Patent Application No(s). 108133416 filed in R.O.C. Taiwan on Sep. 17, 2019, the entire contents of which are hereby incorporated by reference.

TECHNICAL FIELD

The disclosure relates to a sound propagating device, more particularly to a sound propagating device having a sound-reflecting component and a loudspeaker having the sound propagating device.

BACKGROUND

With the development of technology and the continual pursuit of lifestyle upgrading, for the purpose of better entertainment viewing pleasure while using entertainment electronics, such as smartphone, computer, or TV to watch movies or listen music, more and more people prefer to use a wireless loudspeaker to play sounds. As smart home technology progresses to further increases the demand for smart loudspeakers, recently, many loudspeakers with artificial intelligence have been introduced in the market.

This type of loudspeaker can be placed anywhere in the room and can interact with users around it. The feature that a loudspeaker produces radiation of sound with different sound pressure-frequency in different directions is called "directivity". The higher the frequency of the sound, the more obvious the directivity will be. To give the same listening experience to every listener in the room, an omnidirectional loudspeaker is provided to give the same sound pressure-frequency characteristics in all directions. Therefore, the omnidirectional loudspeaker is a loudspeaker that can radiate sound evenly in a 360-degree pattern for more uniform coverage and balanced sound quality for every listener in the room.

However, the conventional omnidirectional loudspeaker discards the advantages of the directional loudspeaker, while the conventional directional loudspeaker cannot achieve the effect of the omnidirectional loudspeaker, either. In the current market, there is yet no loudspeaker that can achieve both advantages of the omnidirectional and directional loudspeakers, and which remains one of the important topics in the field.

SUMMARY

One embodiment of the disclosure provides a loudspeaker including a housing, a speaker unit, a sound-reflecting component, a first baffle plate, a second baffle plate, and a baffle assembly. The speaker unit is located in the housing and having a sound outputting side. The sound-reflecting component is located in the housing and has a conical surface. The sound outputting side of the speaker unit faces toward the conical surface. The first baffle plate and the second baffle plate are respectively connected to two opposite ends of the baffle assembly. The first baffle plate, the second baffle plate, and the baffle assembly are moveably located on the conical surface. An angle between the first baffle plate and the second baffle plate is changed when at least one of the first baffle plate and the second baffle plate is moved.

Another embodiment of the disclosure provides a sound propagating device including a sound-reflecting component, a first baffle plate, a second baffle plate, and a baffle assembly. The sound-reflecting component has a conical surface. The first baffle plate and the second baffle plate are respectively connected to two opposite ends of the baffle assembly. The first baffle plate, the second baffle plate, and the baffle assembly are moveably located on the conical surface. An angle between the first baffle plate and the second baffle plate is changed when at least one of the first baffle plate and the second baffle plate is moved.

BRIEF DESCRIPTION OF THE DRAWINGS

The present disclosure will become better understood from the detailed description given hereinbelow and the accompanying drawings which are given by way of illustration only and thus are not intending to limit the present disclosure and wherein.

DETAILED DESCRIPTION

Figure 1:
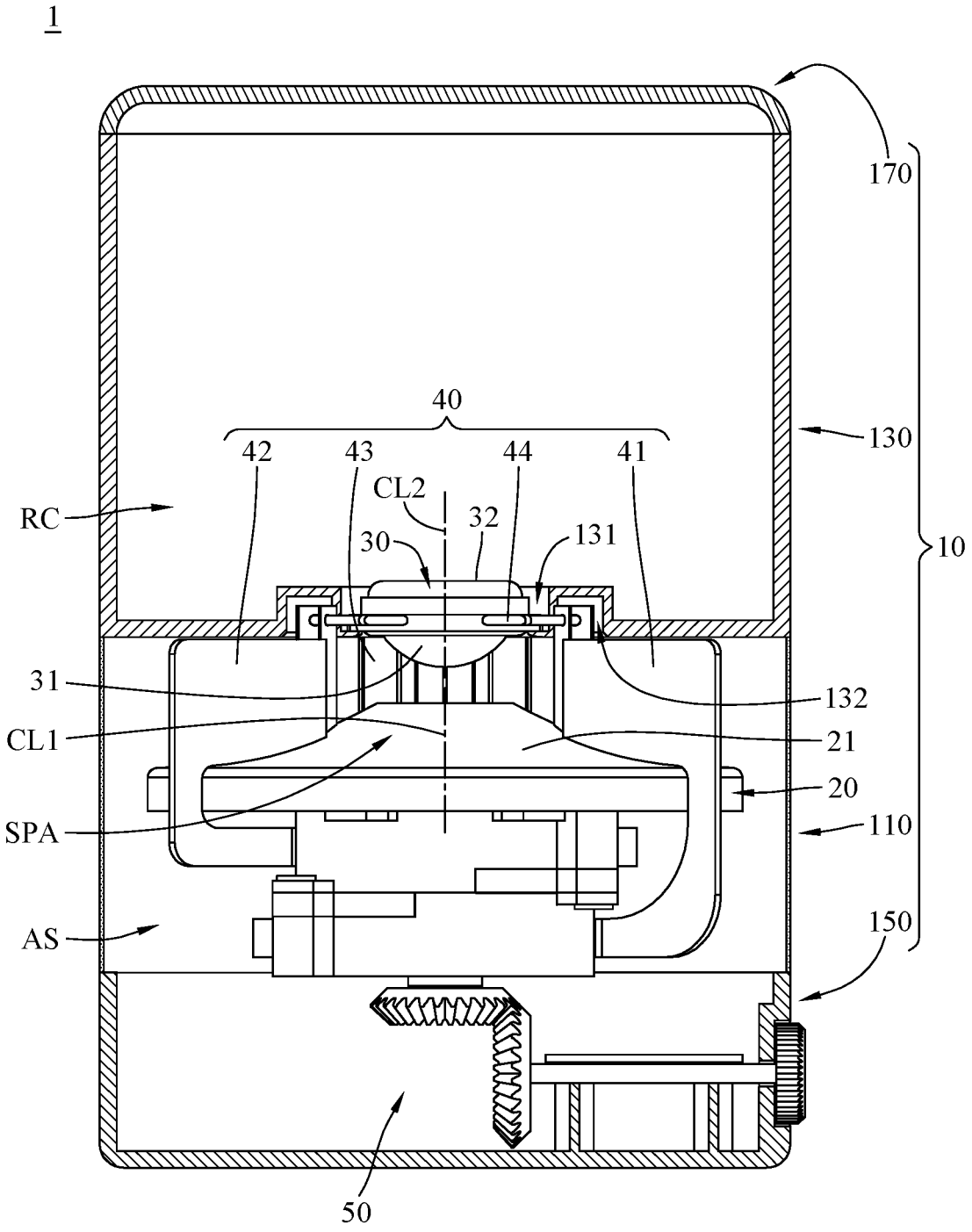
FIG. 1 is a side cross-sectional view of a loudspeaker according to one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details.

In addition, for the purpose of simple illustration, well-known structures and devices are drawn schematically, and some components or unnecessary details may be omitted from the drawings. And the size or ratio of the features in the drawings of the present disclosure may be exaggerated for illustrative purposes, but the present disclosure is not limited thereto. Note that the actual size and designs of the product manufactured based on teaching and suggestion of the present disclosure may also be properly modified according to any actual requirement.

Further, terms, such as "end", "part", "portion" or "area" may be used in the following to describe specific element and structure or specific technical feature on or between them, but these elements, structure and technical feature are not limited by these terms. Also, in the following, it may use terms, such as "substantially", "approximately" or "about"; when these terms are used in combination with size, concentration, temperature or other physical or chemical properties or characteristics, they are used to express that, the deviation existing in the upper and/or lower limits of the range of these properties or characteristics or the acceptable tolerances caused by the manufacturing tolerances or analysis process, would still able to achieve the desired effect.

Furthermore, unless otherwise defined, all the terms used in the disclosure, including technical and scientific terms, have their ordinary meanings that can be understood by those skilled in the art. Moreover, the definitions of the above terms are to be interpreted as being consistent with the technical fields related to the disclosure. Unless specifically defined, these terms are not to be construed as too idealistic or formal meanings.

Figure 2:
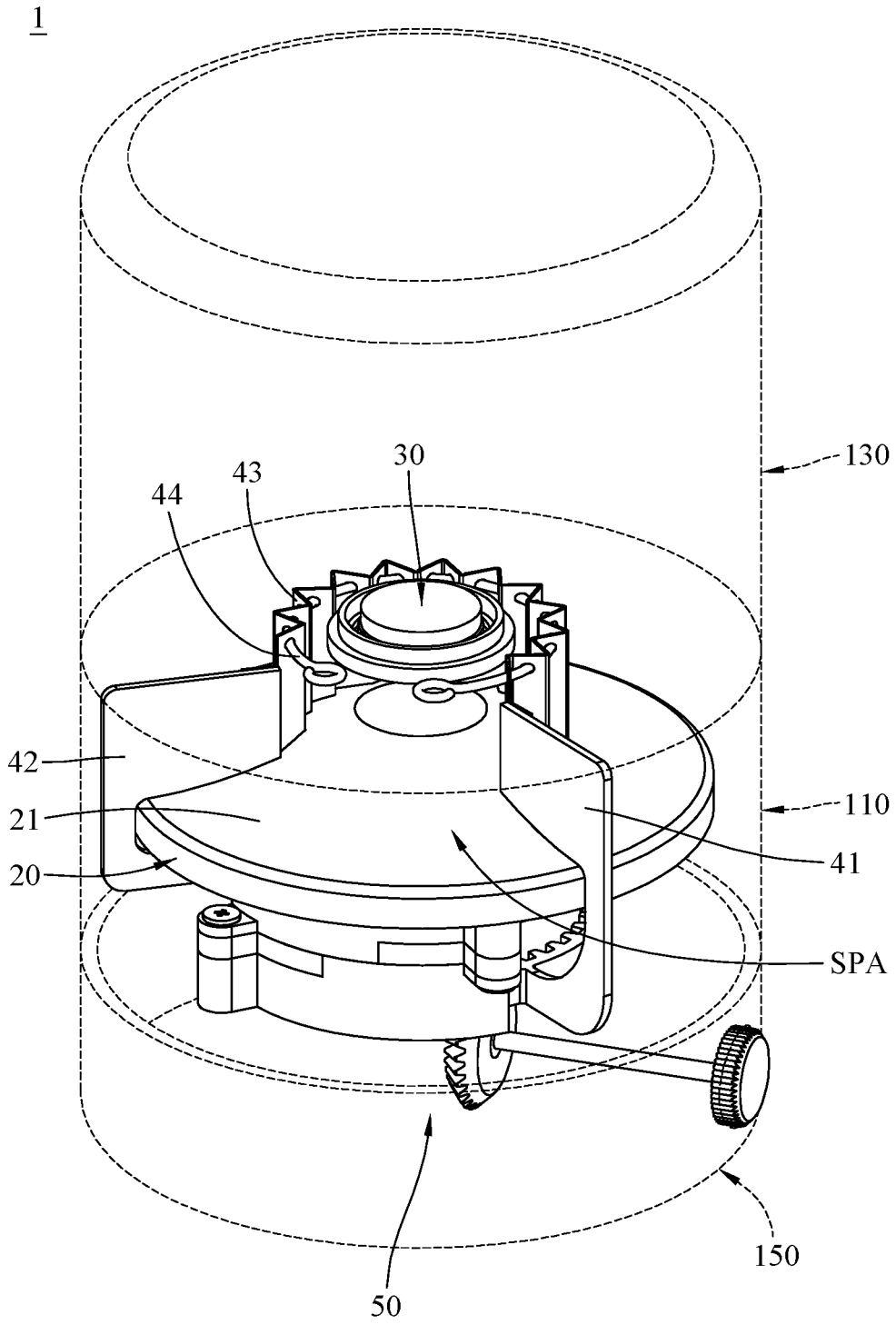
FIGS. 2-3 are perspective views of the loudspeaker in FIG. 1, taken from different angles.
Figure 3:
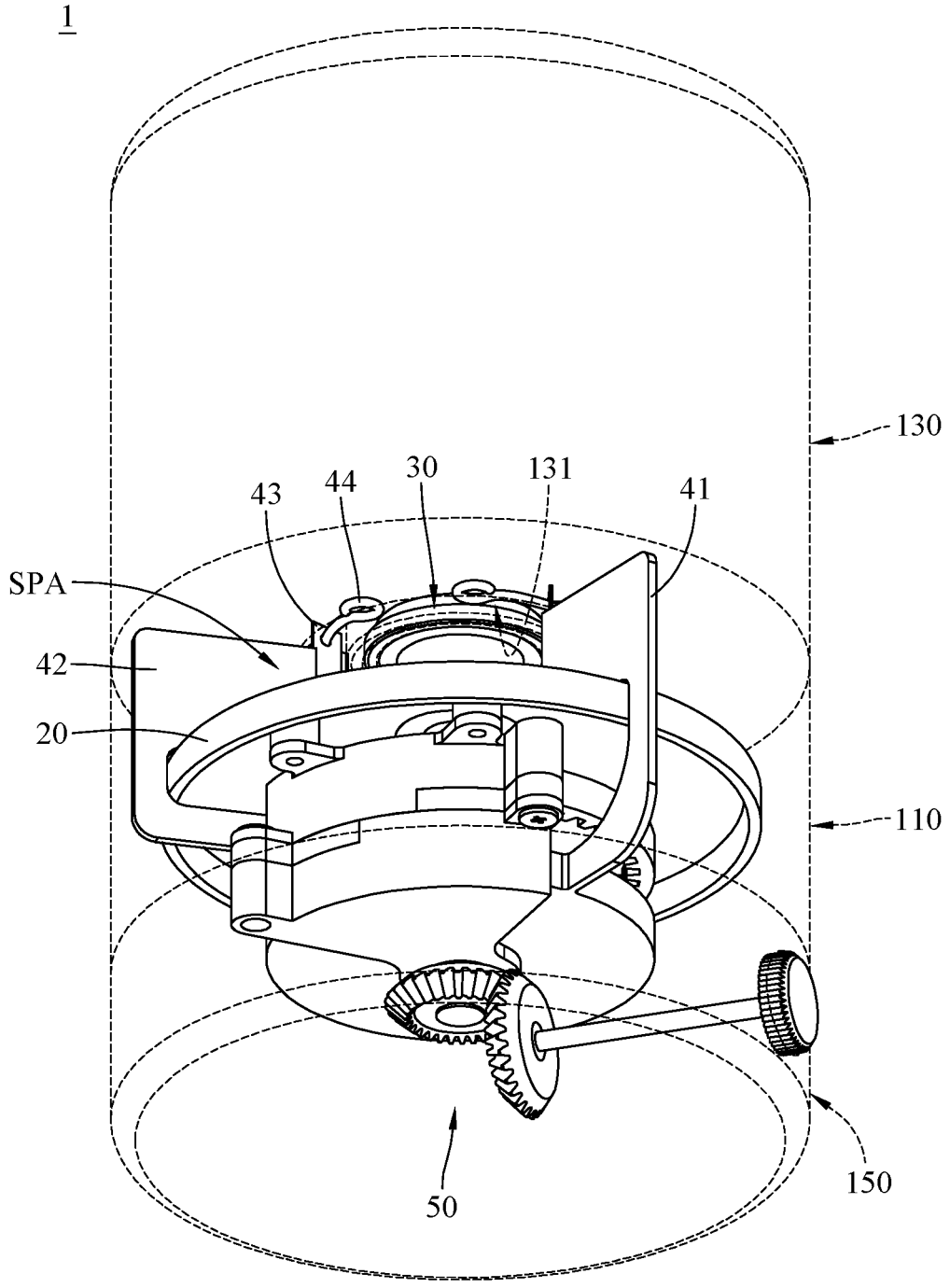
Figure 4:
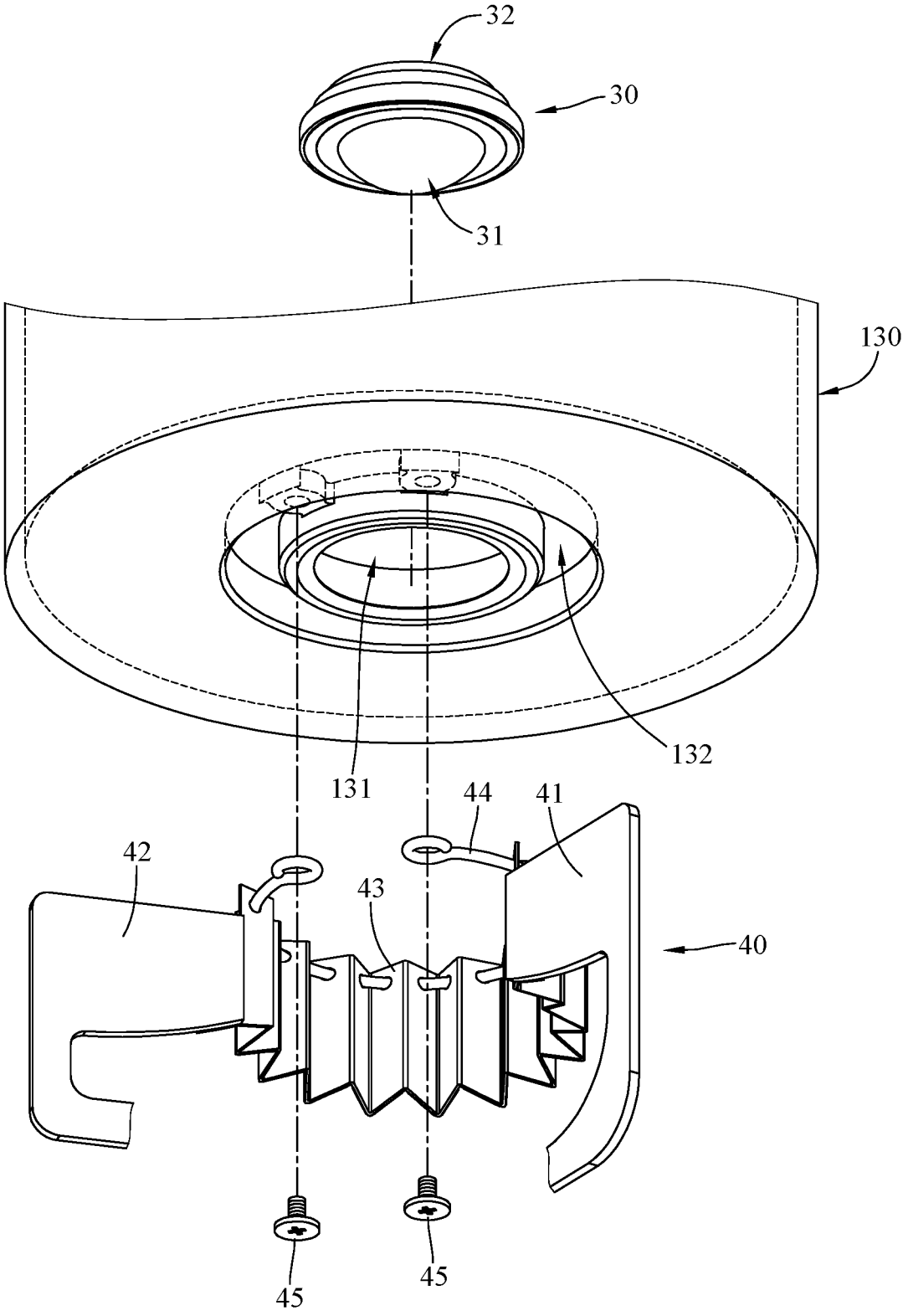
FIG. 4 is a partial exploded view of the loudspeaker in FIG. 3.

Firstly, referring to FIGS. 1-4, FIG. 1 is a side cross-sectional view of a loudspeaker 1 according to one embodiment of the disclosure, FIGS. 2-3 are perspective views of the loudspeaker 1 in FIG. 1, taken from different angles, and FIG. 4 is a partial exploded view of the loudspeaker 1 in FIG. 3.

In this embodiment, the loudspeaker 1 includes a housing 10, a cone 20, a speaker unit 30, and a directivity adjustment assembly 40. As shown in the figures, the cone 20, the speaker unit 30, and the directivity adjustment assembly 40 may be accommodated in the housing 10. It should be noted that, for the purpose of viewing the interior of the housing of the loudspeaker, the whole or part of the housing of the loudspeaker in FIGS. 1-4 and subsequent drawings will be illustrated in a cross-sectional view or dashed line.

Specifically, in this embodiment or some other embodiments, the housing 10 includes a sound output case 110, a resonance chamber case 130, a base case 150, and a lid 170. The sound output case 110 is located between the base case 150 and the resonance chamber case 130, and the resonance chamber case 130 is located between the sound output case 110 and the lid 170. That is, the sound output case 110 and the resonance chamber case 130 are located between the base case 150 and the lid 170. The base case 150, in normal use, is the part of the housing 10 to be placed on a planar surface and used to support other parts, and the lid 170 is the part of the housing 10 opposite to the base case 150; however, the disclosure is not limited by the base case 150, the lid 170, and their design.

In this embodiment and some other embodiments, the sound output case 110 has an accommodation space AS, and the resonance chamber case 130 has a resonance chamber RC. The speaker unit 30 is installed at, for example, a side of the resonance chamber case 130 connected to the sound output case 110, such that the sound generated by the speaker unit 30 can be amplified by the resonance chamber RC of the resonance chamber case 130 and projected forwards the accommodation space AS of the sound output case 110.

Herein, note that the speaker unit 30 may be, but is not limited to, any suitable speaker that can generate sound. In this or other embodiments, the speaker unit 30 is, for example, a tweeter, but the disclosure is not limited by the type of the speaker unit 30. In addition, the resonance chamber case 130 may be made of any material that is suitable to allow the sound generated from the speaker unit 30 to resonate, but the disclosure is either not limited thereto. Also, the shape and size of the resonance chamber RC defined by the resonance chamber case 130 can be modified according to actual requirements, but the disclosure is not limited thereto.

In more detail, in this embodiment or some other embodiments, the resonance chamber case 130 includes a speaker unit mounting portion 131 located at a side of the resonance chamber case 130 connected to the sound output case 110. The speaker unit mounting portion 131 may be, but is not limited to, a through hole connected to the resonance chamber RC of the resonance chamber case 130 and the accommodation space AS of the sound output case 110. The speaker unit 30 can be fixed at the speaker unit mounting portion 131 via, for example, adhesive, engageable features, screws, or any other suitable means.

In this embodiment and some other embodiments, the cone 20 can be accommodated in the accommodation space AS. The cone 20 is a sound-reflecting component configured to reflect and guide the sound generated from the speaker unit 30 outwards the sound output case 110. Regarding the arrangement of the cone 20, the cone 20 can be arranged in a way that its central line CL1 is coaxial with a central line CL2 of the speaker unit 30 to ensure that the sound generated from the speaker unit 30 can be evenly guided and reflected by the cone 20, but the disclosure is not limited thereto. For example, in some other embodiments, the central line CL1 of the cone 20 and the central line CL2 of the speaker unit 30 may be non-coaxial. In more detail, in this embodiment or some other embodiments, the speaker unit 30 has a sound outputting side 31 and a rear side 32 opposite to each other, the sound outputting side 31 faces toward the cone 20 and is located in the accommodation space AS of the sound output case 110, and the rear side 32 faces toward the resonance chamber case 130 and is located in the resonance chamber RC of the resonance chamber case 130. The cone 20 is substantially in a cone shape and at least has a conical surface substantially facing toward the sound outputting side 31 of the speaker unit 30, such that the sound emitted from the sound outputting side 31 of the speaker unit 30 can be reflected by the conical surface 21 so as to be guided outward the sound output case 110. Note that the conical surface 21 can be modified to be any suitable shape for guiding the sound toward the desired direction or area according to actual requirements. For example, in another embodiment, the tip end of the cone 20 may be made sharp, flat, or rounded to a concave or convex shape, but the disclosure is not limited thereto. In addition, the cone 20, according to actual requirements, may be made of any material that is suitable to reflect/guide the sound generated from the speaker unit 30 and is sound-impermeable to the sound generated from the speaker unit 30, but the disclosure is either not limited thereto. The capabilities of the cone 20 in "suitable to reflect/guide the sound generated from the speaker unit 30" and "sound-impermeable to the sound generated from the speaker unit 30" can be modified according to actual requirements and are not particularly restricted.

Further, the sound output case 110, according to actual requirements, may be made of any material or in any configuration that is suitable for the penetration of the sound generated from the speaker unit 30, such as metal mesh or grill foam, but the disclosure is not limited thereto. Furthermore, the sound output case 110 may not be shaped to surround the cone 20 by 360 degrees; for example, in some other embodiments, the sound output case 110 may be in a form of multiple separated support posts (e.g., the support posts 111''' in FIG. 12 as illustrated in the later embodiment) that connects the resonance chamber case 130 and the base case 150, in such an arrangement, the accommodation space of the sound output case becomes an open space, such that the cone 20 and the components thereon are directly exposed.

In this embodiment or some other embodiments, the directivity adjustment assembly 40 may be disposed in the accommodation space AS of the sound output case 110, and at least part of the directivity adjustment assembly 40 is located between the resonance chamber case 130 and the conical surface 21 of the cone 20 so as to define a sound pressure adjustment area SPA in the accommodation space AS of the sound output case 110. As shown in FIGS. 1 and 2, the sound outputting side 31 of the speaker unit 30 is located in the sound pressure adjustment area SPA. The directivity adjustment assembly 40 and the cone 20 may together form a type of sound propagating device.

Figure 5:
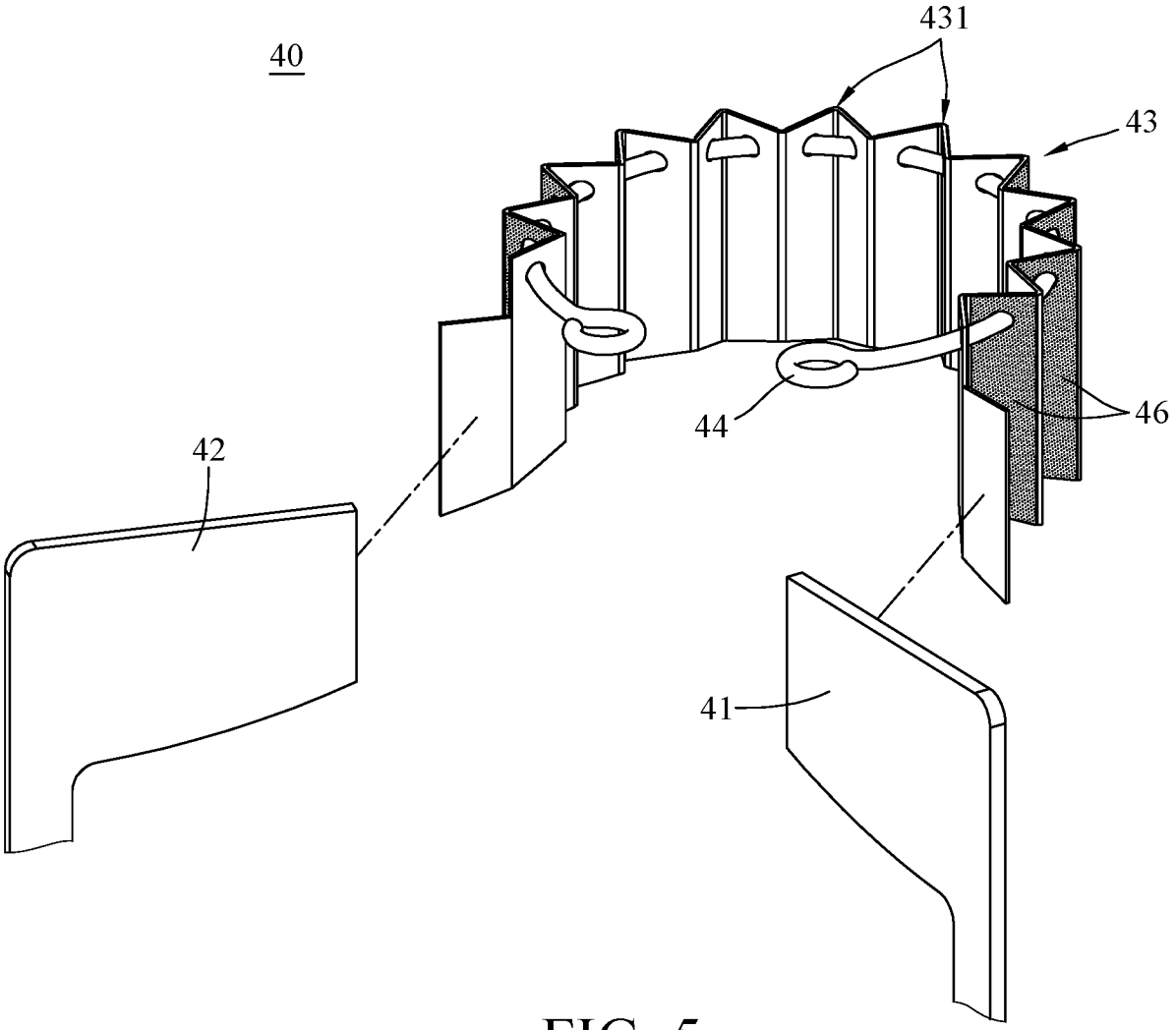
FIG. 5 is an exploded view of a directivity adjustment assembly of the loudspeaker in FIG. 1.

Regarding the directivity adjustment assembly 40, please further refer to FIG. 5 to see the exploded view of the directivity adjustment assembly 40. Specifically, in this embodiment or some other embodiments, the directivity adjustment assembly 40 may at least include a first baffle plate 41, a second baffle plate 42, a baffle assembly 43, and a baffle guiding component 44.

The baffle assembly 43 is configured to eliminate the possible gap or opening connecting to the speaker unit 30 during the relative movement of the first baffle plate 41 and the second baffle plate 42, which helps to complete the desired space defined by the baffle assembly 43, the first baffle plate 41, the second baffle plate 42, and the sound output case 110. In one embodiment of the disclosure, the baffle assembly 43 may include a plurality of foldable structures 431, and such arrangement makes the baffle assembly 43 become a foldable and flexible baffle plate. As shown in FIGS. 2 and 5, in this embodiment, the foldable structures 431 of the baffle assembly 43 are connected in a series to surround the speaker unit 30, and each foldable structure 431 includes, for example, at least two thin plate pieces (not numbered) connected to each other. Therefore, each foldable structure 431 may at least have a fold, the folds make the baffle assembly 43 capable of being opened or closed, such that area that is defined by the baffle assembly 43 and located between the speaker unit 30 and the conical surface 21 of the cone 20 can be changed. More specifically, as the baffle assembly 43 is unfolded towards an open position, the area that is surrounded by the baffle assembly 43 and located between the speaker unit 30 and the conical surface 21 of the cone 20 may be substantially in a circular or cylindrical shape; on the other hand, as the baffle assembly 43 is folded towards a closed position, the area that is surrounded by the baffle assembly 43 and located between the speaker unit 30 and the conical surface 21 of the cone 20 may be substantially reduced to a semicircular shape or a minor segment of circular. However, the disclosure is not limited by the above configuration of the baffle assembly 43; for example, in some other embodiments, the baffle assembly may be replaced with two curved structures which are stacked on each other and respectively connected to the first baffle plate 41 and the second baffle plate 42 to be positioned at a side of the speaker unit 30.

The baffle guiding component 44 may be, but is not limited to, a ring-shaped structure with or without ends (not numbered). The baffle guiding component 44 is disposed through the foldable structures 431 of the baffle assembly 43, such that the baffle assembly 43 can be opened and closed along the baffle guiding component 44. Therefore, when the baffle assembly 43 is relatively opened, the foldable structures 431 can be arranged in a form of surrounding the speaker unit 30; when the baffle assembly 43 is relatively closed, the plate pieces of the foldable structures 431 can be pivoted and stacked on each other so that the foldable structures 431 can be gathered at a side of the speaker unit 30.

Note that the moveable range of the baffle assembly 43 on the baffle guiding component 44 is related to the actual length of the fully opened baffle assembly 43 and is also related to the length of the baffle guiding component 44; however, these factors all can be modified or changed according to actual requirements and are not particularly restricted.

In this embodiment or some other embodiments, the resonance chamber case 130 may further include a baffle guiding portion 132. The baffle guiding portion 132 may be, but is not limited to, an annular groove formed on the surface (not numbered) of the resonance chamber case 130 facing the sound output case 110. The annular groove surrounds the speaker unit mounting portion 131; that is, the annular groove surrounds the speaker unit 30 that is located in the speaker unit mounting portion 131. At least part of the baffle assembly 43 and the baffle guiding component 44 thereon may be accommodated in the baffle guiding portion 132. Two ends (not numbered) of the baffle guiding component 44 can be respectively fixed in position in the baffle guiding portion 132 via two fasteners 45 or any other suitable manners. As such, the baffle guiding portion 132 can provide a certain degree of restriction to the movement of the baffle assembly 43, thus the baffle assembly 43 can only be opened or closed along the baffle guiding portion 132. That is, the baffle guiding portion 132 is able to guide the baffle assembly 43, such that the baffle assembly 43 can be opened or closed along a determined path surrounding the speaker unit 30 in the speaker unit mounting portion 131. Accordingly, the baffle guiding portion 132 and the baffle guiding component 44 together form a guide mechanism for guiding or assisting the movement of the baffle assembly 43, but such guide mechanism is exemplary and the disclosure is not limited thereto.

In addition, another side of the baffle assembly 43 opposite the baffle guiding portion 132 may be, but is not limited to, in contact with or pressing against the conical surface 21 of the cone 20 or having an ignorable clearance with respect to the conical surface 21 of the cone 20, such that the baffle assembly 43 is also moved along the conical surface 21 of the cone 20 while being opened or closed.

In this embodiment and some other embodiments, the baffle assembly 43, according to actual requirements, may be made of any material that is flexible and also sound-impermeable to the sound generated from the speaker unit 30, and the baffle assembly 43 may be, but is not limited to, a single-layer or multiple-layer structure, but the disclosure is not limited thereto. Note that the capability of the baffle assembly 43 in "sound-impermeable to the sound generated from the speaker unit 30" can be modified according to actual requirements and is not particularly restricted.

In addition, in this embodiment or some other embodiments, the baffle assembly 43 may be disposed with a plurality of reinforcement plates 46. The reinforcement plates 46 may be attached to or embedded into the plate pieces of the foldable structures 431 of the baffle assembly 43. The material hardness of the reinforcement plate 46 may be greater than that of the baffle assembly 43, thus the reinforcement plate 46 can help to increase the structural strength of the baffle assembly 43 to prevent the baffle assembly 43 from bending or deforming to unexpected or unwanted position while being opened or closed. Note that the quantity, thickness, shape, and material of the reinforcement plate 46 are not particularly restricted and can be modified according to actual requirements. The reinforcement plate 46 may even be omitted; for example, in some other embodiments, there may be no reinforcement plate 46 on the baffle assembly 43 if the structural strength of the baffle assembly 43 meets the requirement.

In this embodiment and some other embodiments, the first baffle plate 41 and the second baffle plate 42 are respectively connected to two opposite ends of the baffle assembly 43. Regarding their positions, the first baffle plate 41, the second baffle plate 42, and baffle assembly 43 are located between the conical surface 21 of the cone 20 and the resonance chamber case 130, such that the first baffle plate 41, the second baffle plate 42, and the baffle assembly 43 can define the sound pressure adjustment area SPA in the accommodation space AS of the sound output case 110. As shown in the figures, the sound pressure adjustment area SPA is defined by first baffle plate 41, the second baffle plate 42, the baffle assembly 43, the conical surface 21 of the cone 20, and the resonance chamber case 130.

Note that, in the drawings shown in this embodiment or some other embodiments, although the resonance chamber case 130 is arranged above the sound output case 110, the disclosure is not limited thereto. As long as the directivity adjustment assembly 40 is located between the resonance chamber case 130 and the conical surface 21 of the cone 20 (i.e., the first baffle plate 41, the second baffle plate 42, and the baffle assembly 43 are located between the conical surface 21 of the cone 20 and the resonance chamber case 130), in some other embodiments, the sound output case 110 may be arranged above the resonance chamber case 130, in such an arrangement, the conical surface 21 of the cone 20 may face downward while using.

In addition, in this embodiment and some other embodiments, the edges of the first baffle plate 41 and the second baffle plate 42 may contact or slightly touch the conical surface 21 of the cone 20 and the resonance chamber case 130 or have ignorable clearances with respect to the conical surface 21 and the resonance chamber case 130. Specifically, as shown in the figures, in this embodiment, at least one of the first baffle plate 41 and the second baffle plate 42 may be in a shape partially matching the conical surface 21 of the cone 20 and the resonance chamber case 130; that is, at least one of the first baffle plate 41 and the second baffle plate 42 has a bottom edge (not numbered) matching the shape of the conical surface 21 of the cone 20, and at least one of the first baffle plate 41 and the second baffle plate 42 has a top edge (not numbered) matching the bottom surface of the resonance chamber case 130. As such, the completeness of the sound pressure adjustment area SPA is secured. However, the disclosure is not limited by the shapes of the first baffle plate 41 and the second baffle plate 42; for example, in some other embodiments, one or both of the first baffle plate and the second baffle plate of the directivity adjustment assembly may be in a shape not matching the conical surface of the cone.

Note that, the first baffle plate 41 and the second baffle plate 42, according to actual requirements, may be made of any material that is suitable to reflect/guide the sound generated from the speaker unit 30 and is sound-impermeable to the sound generated from the speaker unit 30, and the first baffle plate 41 and the second baffle plate 42 may be, but are not limited to, a single-layer or multiple-layer structure, but the disclosure is not limited thereto. Note that the capability of the first baffle plate 41 and the second baffle plate 42 in "sound-impermeable to the sound generated from the speaker unit 30" can be modified according to actual requirements and is not particularly restricted.

As the arrangement discussed above, the sound, that is emitted from the sound outputting side 31 of the speaker unit 30 and coming out of the sound output case 110, has to travel through the sound pressure adjustment area SPA that is defined by the first baffle plate 41, the second baffle plate 42, the baffle assembly 43, the conical surface 21 of the cone 20, and the resonance chamber case 130, thus the sound pressure-frequency characteristics of the sound emitted in a specific direction can be changed to the desired level. Accordingly, adjusting the directivity of the loudspeaker 1 is possible.

Specifically, in this embodiment and some other embodiments, changing the shape or size of the sound pressure adjustment area SPA can increase or decrease the degree of compression to the sound therein so as to change the sound pressure of the sound emitted in a specific direction; that is, the directivity of the loudspeaker 1 can be adjusted by changing the shape or size of the sound pressure adjustment area SPA.

Figure 6:
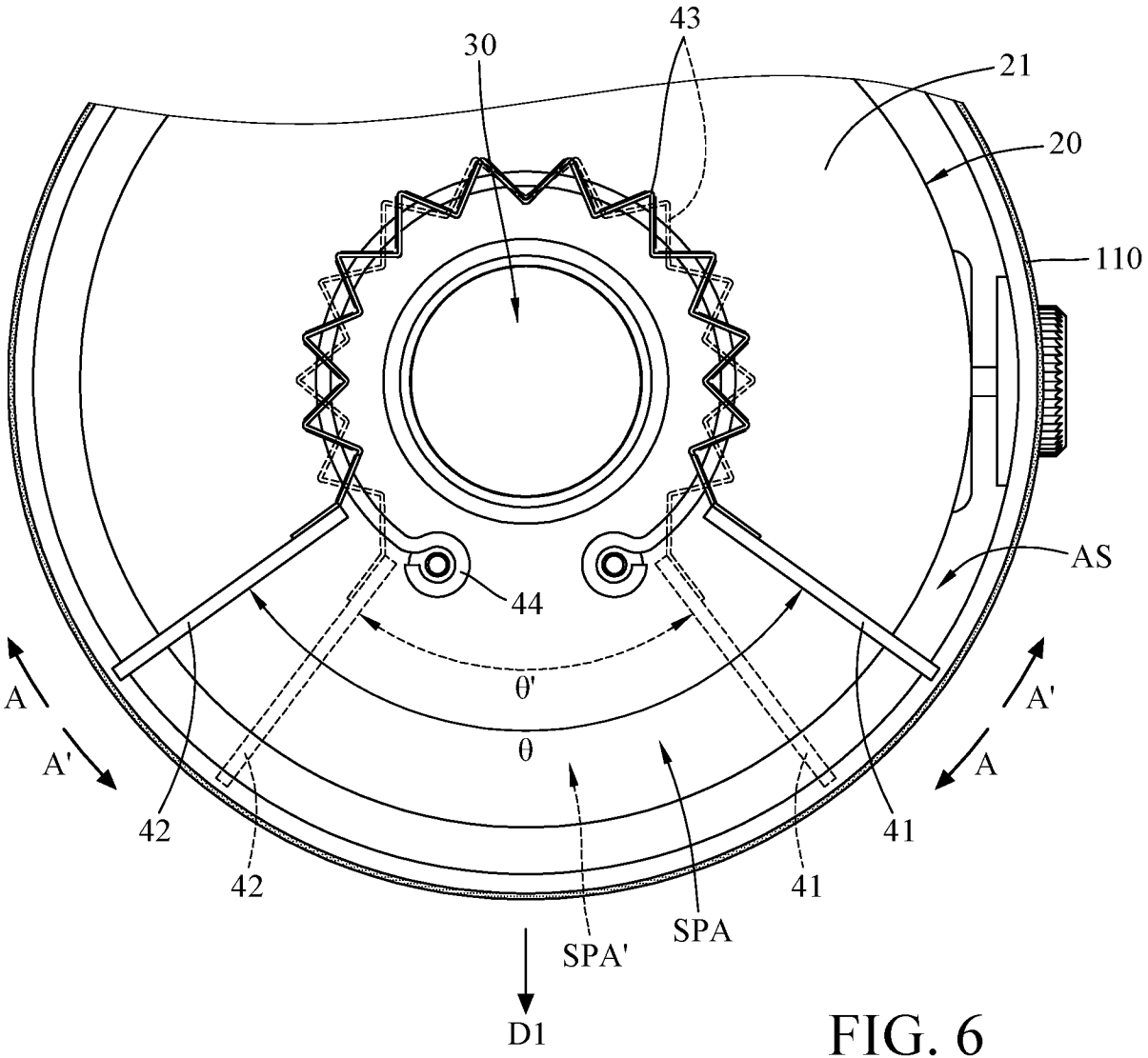
FIG. 6 is a top view of the loudspeaker in FIG. 1.

More specifically, referring to FIG. 6, FIG. 6 is a top view of the loudspeaker 1 in FIG. 1, one or both of the first baffle plate 41 and the second baffle plate 42 can be moved with respect to the speaker unit 30 in the arrow A or arrow A'. During the movement of the first baffle plate 41 and the second baffle plate 42, the angle θ between the first baffle plate 41 and the second baffle plate 42 is changed, and the baffle assembly 43 can be opened or closed by forced by the first baffle plate 41 and the second baffle plate 42, such that the range of the sound pressure adjustment area SPA, which is defined by the first baffle plate 41, the second baffle plate 42, the baffle assembly 43, the conical surface 21 of the cone 20, and the resonance chamber case 130, can be increased or decreased according to the changes in the positions of the first baffle plate 41 and/or the second baffle plate 42. As show in FIG. 6, as the actuating mechanism 50 drives the first baffle plate 41 to pivot along the arrow A to the position of the dotted lined first baffle plate 41 and drives the second baffle plate 42 to pivot along the arrow A' to the position of the dotted lined second baffle plate 42, the angle θ between the first baffle plate 41 and the second baffle plate 42 is decreased to θ' so that the sound pressure adjustment area SPA is decreased to SPA'. During such change of the sound pressure adjustment area SPA, the sound, that emitted from the speaker unit 30 and enters this area, is compressed and guided, the sound pressure of the sound emitted in the direction D1 is increased and thus strengthening the directivity of the loudspeaker 1 in the direction D1. In practical use, the sound pressure of the sound emitted toward the user on the direction D1 can be increased by adjusting the positions of the first baffle plate 41 and the second baffle plate 42 so that the user on the direction D1 can obtain a stronger listening experience.

Figure 7:
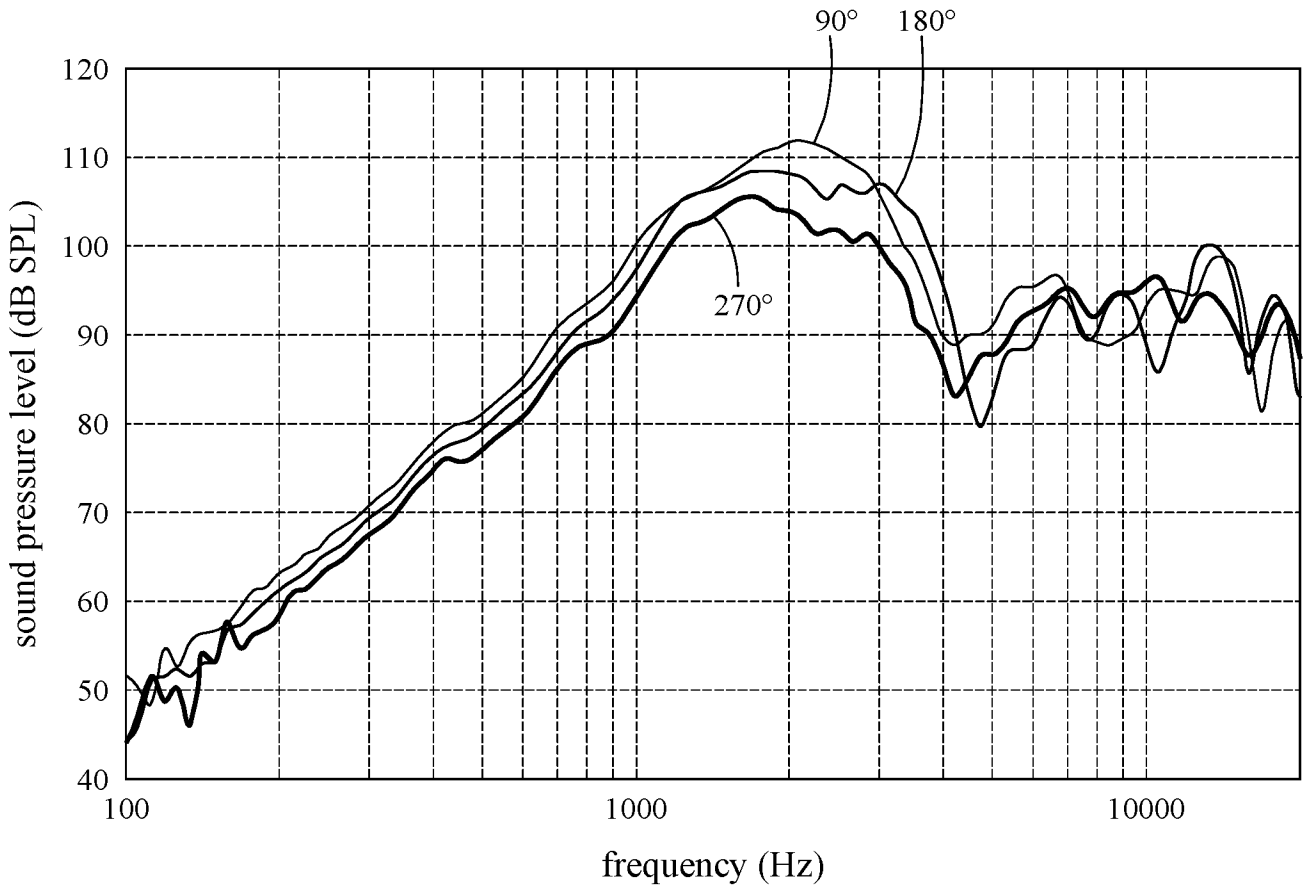
FIG. 7 shows a frequency response analysis of the loudspeaker in FIG. 1 performed in different angles between the first baffle plate and the second baffle plate.

Herein, referring to FIG. 7, FIG. 7 shows a frequency response analysis of the loudspeaker in FIG. 1 performed in different angles between the first baffle plate 41 and the second baffle plate 42. Specifically, this analysis includes three frequency responses that were measured at a distance of approximately 10 centimeters and direction from the loudspeaker 1 under the conditions of applying the same voltage to the speaker unit 30 and three different angles (90, 180, and 270 degrees) between the first baffle plate 41 and the second baffle plate 42. As can be clearly seen in FIG. 7, as the angle θ between the first baffle plate 41 and the second baffle plate 42 is reduced to 90 degrees, the sound pressure level (SPL) is higher than that as the angle θ is 180 and 270 degrees at the same position, wherein the SPL has the unit of decibels (dB). This shows that decreasing the angle θ between the first baffle plate 41 and the second baffle plate 42 to decrease the sound pressure adjustment area SPA can increase the sound pressure level to achieve a higher degree of directivity.

On the other hand, referring back to FIG. 6, the directivity of the loudspeaker 1 at a given distance and direction can be decreased by respectively pivoting the first baffle plate 41 and the second baffle plate 42 in arrow A' and arrow A. Further, when the first baffle plate 41 and the second baffle plate 42 are pivoted to the other side opposite the direction D1, the sound reflected by the cone 20 can be propagated evenly in all directions, such that the loudspeaker 1 can be switched to an omnidirectional loudspeaker from a directional loudspeaker. At this moment, the sound generated from the speaker unit 30 and radiated by the cone 20 would have more balanced and consistent sound pressure-frequency characteristics in all directions. Accordingly, it is understood that the loudspeaker 1 of this embodiment can be switched between a directional loudspeaker and an omnidirectional loudspeaker by adjusting the positions of the first baffle plate 41 and the second baffle plate 42, such that the loudspeaker 1 has both advantages of omnidirectional and directional loudspeakers. Consequently, the loudspeaker 1 can be adjusted according to different requirements and application environments to achieve high adaptability and applicability.

Figure 8A:
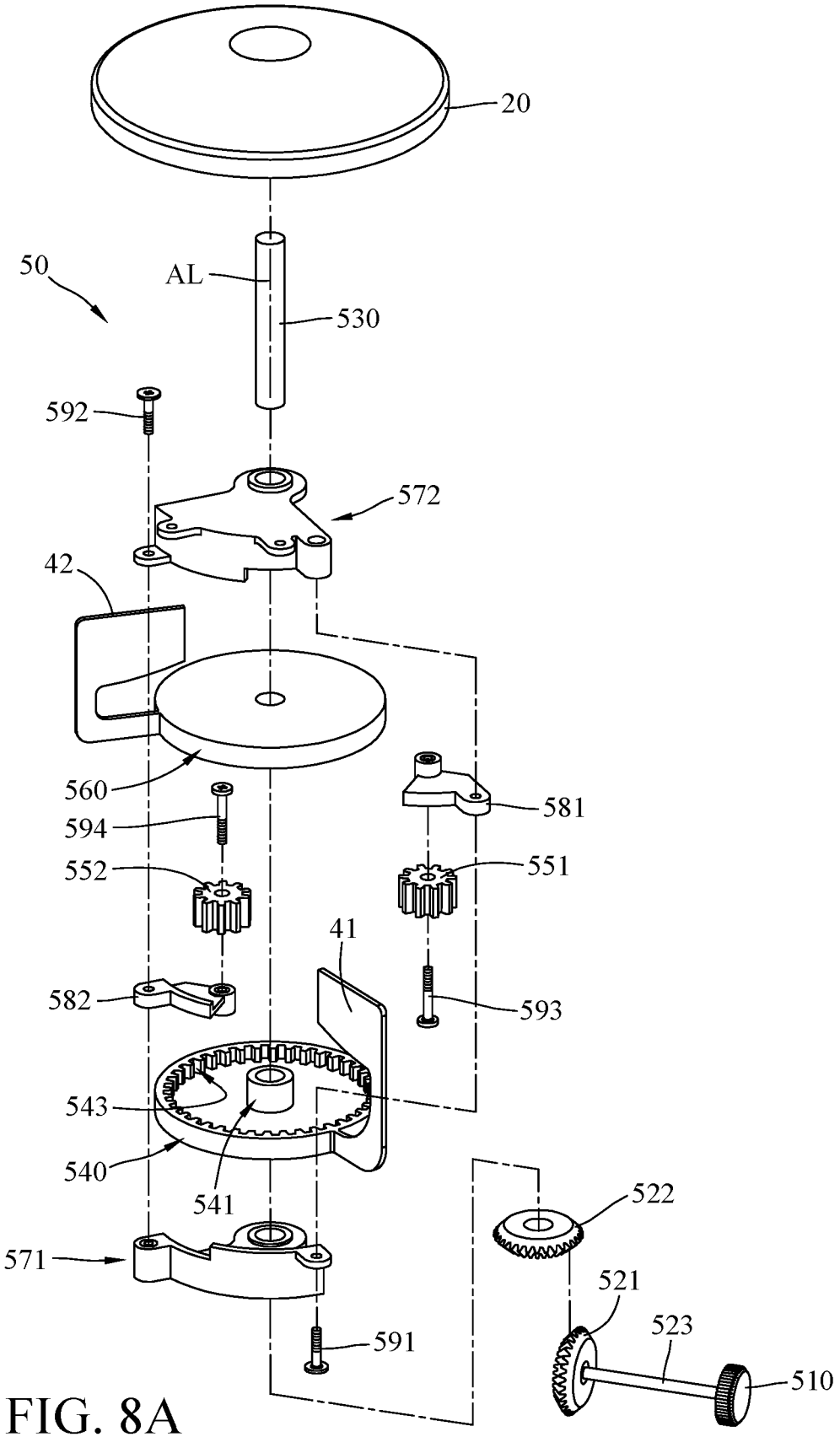
FIGS. 8A-8B are exploded views of an actuating mechanism of the loudspeaker in FIG. 1, taken from different angles.
Figure 8B:
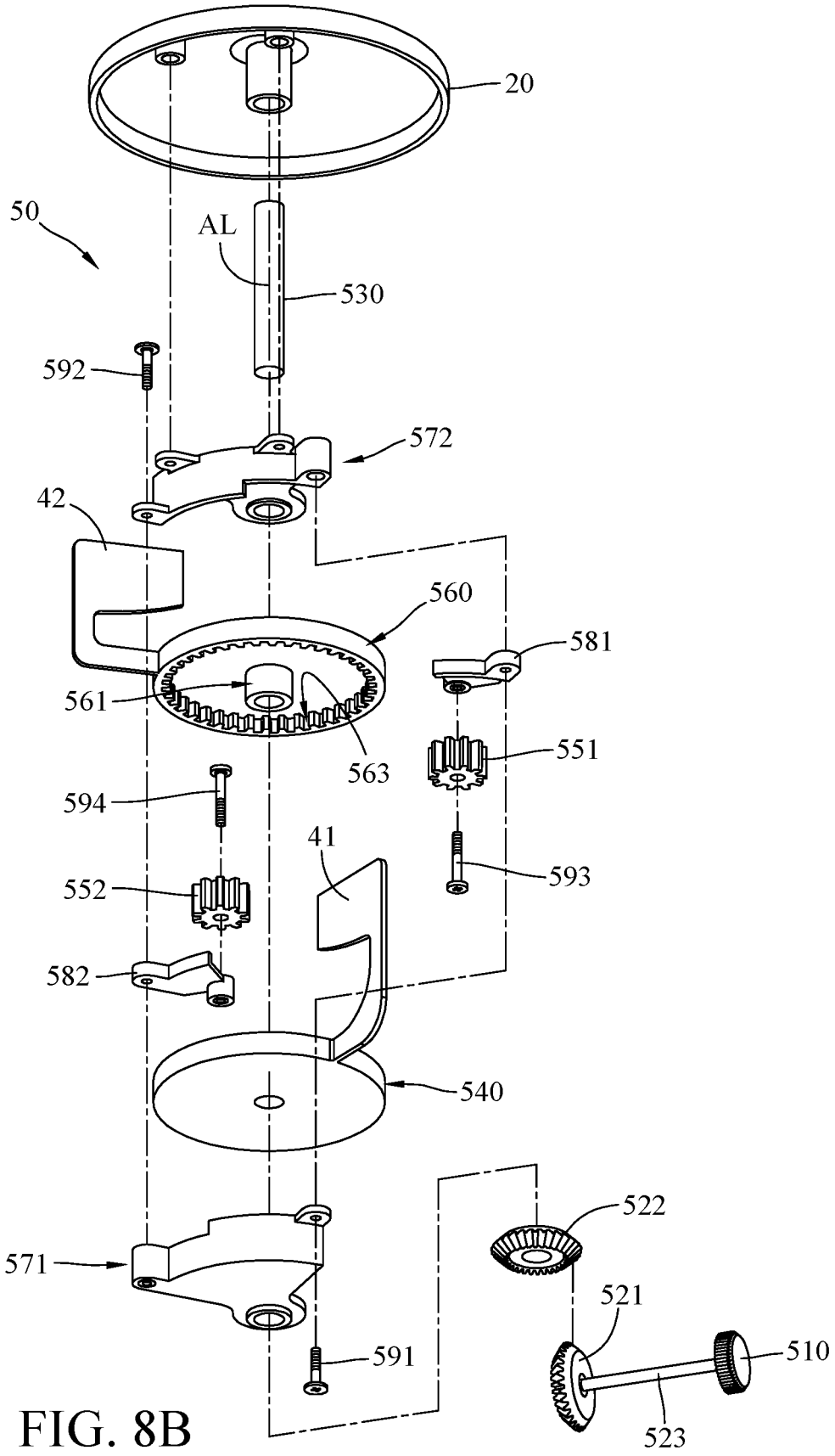
Figure 9:
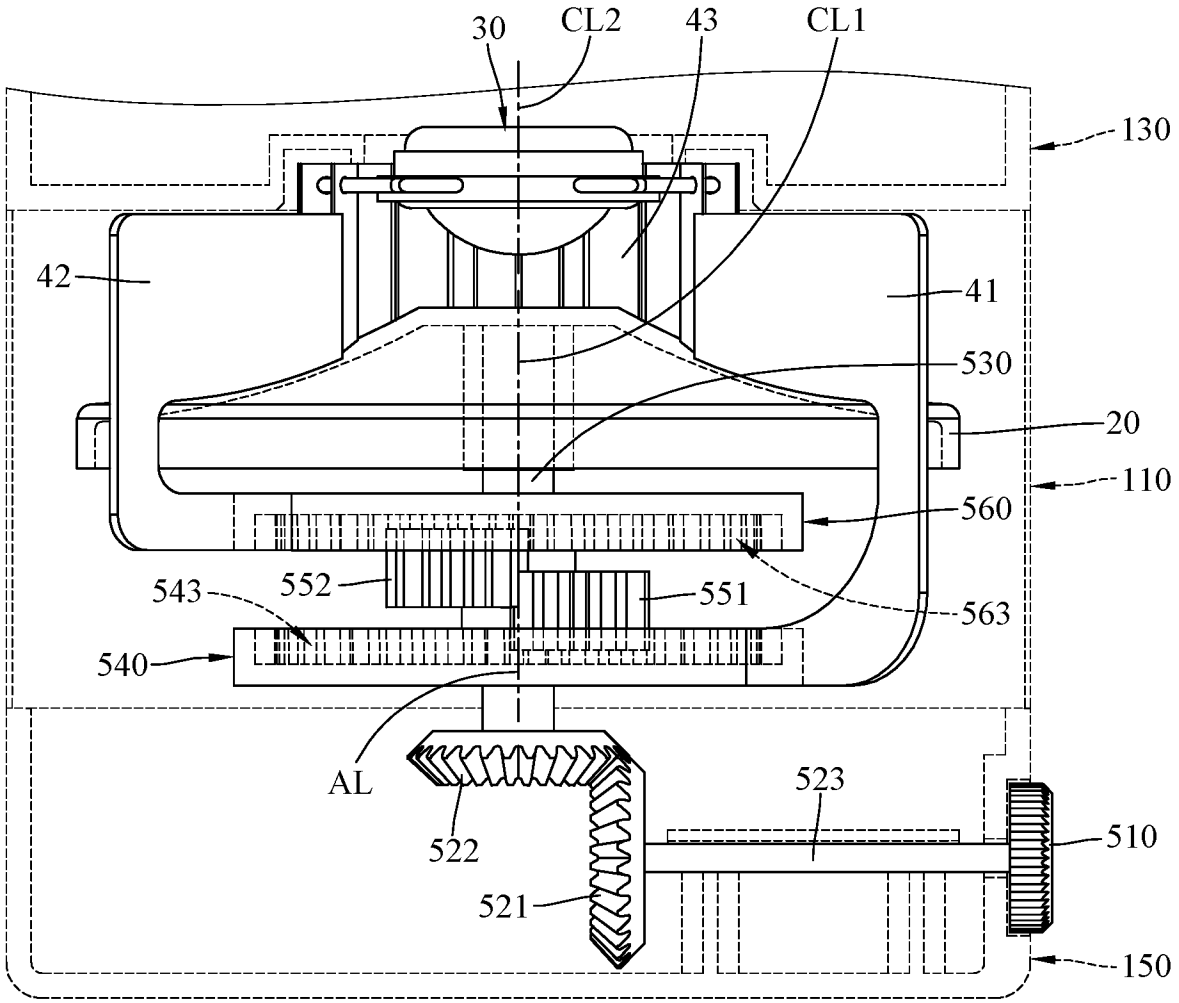
FIG. 9 is a partial enlarged side view of the loudspeaker in FIG. 1.

Note that the movements of the first baffle plate 41 and/or the second baffle plate 42 can be achieved manually or automatically, and the disclosure is not limited thereto. This embodiment provides an actuating mechanism 50 as an example for achieving the movements of the first baffle plate 41 and/or the second baffle plate 42. Herein, referring back to FIGS. 1-3 and further referring to FIGS. 8A-9, where FIGS. 8A-8B are exploded views of the actuating mechanism 50 of the loudspeaker 1 in FIG. 1, taken from different angles, and FIG. 9 is a partial enlarged side view of the loudspeaker 1 in FIG. 1.

Generally, in this embodiment, the loudspeaker 1 may further include an actuating mechanism 50. The actuating mechanism 50 may be accommodated in the housing 10. Specifically, at least part of the actuating mechanism 50 is disposed in, for example, the sound output case 110, and the other part of the actuating mechanism 50 is disposed in, for example, the base case 150. The first baffle plate 41 and the second baffle plate 42 are connected to the actuating mechanism 50, and at least one of the first baffle plate 41 and the second baffle plate 42 can be pivoted with respect to the speaker unit 30 by the actuating mechanism 50. Therefore, the directivity adjustment assembly 40 can be moved by the actuating mechanism 50 to adjust the degree of directivity of the loudspeaker 1.

In detail, in this embodiment, the actuating mechanism 50 includes an actuating component 510, a first bevel gear 521, a second bevel gear 522, a shaft 530, a first disc body 540, a first spur gear 551, a second spur gear 552, and a second disc body 560. In addition, the actuating mechanism 50 further includes a first frame body 571, a second frame body 572, a first spur gear bracket 581, a second spur gear bracket 582, a first fastener 591, a second fastener 592, a third fastener 593, and a fourth fastener 594.

The first disc body 540 and the second disc body 560 are located in the accommodation space AS of the sound output case 110 and spaced apart from each other. The first baffle plate 41 and the second baffle plate 42 are respectively connected to the edges of the first disc body 540 and the second disc body 560. In this embodiment, the first baffle plate 41 and the first disc body 540 may be, but is not limited to, made of a single piece, and the second baffle plate 42 and the second disc body 560 may be, but is not limited to, made of a single piece; however, the disclosure is not limited thereto. For example, in some other embodiments, the first baffle plate 41 and the first disc body 540 may be two independent pieces fixed in position via adhesive or other suitable means, and the second baffle plate 42 and the second disc body 560 may also be two independent pieces fixed in position via adhesive or other suitable means.

In this embodiment, the shaft 530 has an axis AL, the first disc body 540 has a first shaft mount portion 541, and the second disc body 560 has a second shaft mount portion 561. The first shaft mount portion 541 and the second shaft mount portion 561 may be, but is not limited to, through holes that are aligned in the axis AL. The shaft 530 may be inserted into the second shaft mount portion 561 of the second disc body 560 and the first shaft mount portion 541 of the first disc body 540. The second shaft mount portion 561 of the second disc body 560 is rotatably disposed on the shaft 530, such that the second disc body 560 is rotatable with respect to the shaft 530. The first shaft mount portion 541 of the first disc body 540 is non-rotatably fixed on the shaft 530, such that the first disc body 540 can be rotated by being driven by the shaft 530.

One end of the shaft 530 may be, but is not limited to, pivotably connected to the side of the cone 20 facing away from the resonance chamber case 130, but the disclosure is not limited thereto. For example, in some other embodiments, the shaft 530 may be not in contact with the cone 20.

The actuating component 510 is rotatably disposed at a side of the base case 150 and partially exposed from the base case 150. In this embodiment, the actuating component 510 is, for example, a knob for the user to operate the actuating mechanism 50. The first bevel gear 521 and the second bevel gear 522 may be, but is not limited to, gears that are meshed to each other and their axes intersect. The actuating component 510 is connected to the first bevel gear 521 via a transmission bar 523, thus, as the actuating component 510 is rotated, the actuating component 510 can rotate the first bevel gear 521 through the transmission bar 523. The second bevel gear 522 is fixed to another end of the shaft 530 away from the cone 20 so that the second bevel gear 522 is located at the side of the first disc body 540 away from the cone 20. The second bevel gear 522 is engaged with the first bevel gear 521. Therefore, as the first bevel gear 521 is rotated, the first bevel gear 521 is able to rotate the second bevel gear 522 so as to rotate the shaft 530 as well as the first disc body 540 and the first baffle plate 41 that are fixed to the shaft 530. Note that the disclosure is not limited by the first bevel gear 521 and the second bevel gear 522 shown in the figures and their types, gear ratio, and angles of axes.

Further, in this embodiment, the first disc body 540 includes a first internal teeth 543, the second disc body 560 includes a second internal teeth 563, where the first internal teeth 543 is formed at the internal edge of the first disc body 540 and protruding towards the shaft 530, and the second internal teeth 563 is formed at the internal edge of the second disc body 560 and protruding towards the shaft 530.

The second frame body 572 and the first spur gear bracket 581 may be fixed at the side of the cone 20 away from the resonance chamber case 130 via the first fastener 591. At least part of the first spur gear bracket 581 may be located between the second disc body 560 and the first disc body 540. The first spur gear 551 may be fixed to the first spur gear bracket 581 via the third fastener 593 so that the first spur gear 551 is located between the first internal teeth 543 of the first disc body 540 and the first shaft mount portion 541 and engaged with the first internal teeth 543.

The first frame body 571 and the second spur gear bracket 582 may be fixed on the second frame body 572 via the second fastener 592. At least part of the second spur gear bracket 582 is located between the second disc body 560 and the first disc body 540. The second spur gear 552 may be fixed on the second spur gear bracket 582 via the fourth fastener 594 so that the second spur gear 552 is located between the second internal teeth 563 of the second disc body 560 and the second shaft mount portion 561 and engaged with the second internal teeth 563 and the first spur gear 551. In such an arrangement, the first internal teeth 543 of the first disc body 540 is engaged with the first spur gear 551, the first spur gear 551 is engaged with the second spur gear 552, and the second spur gear 552 is engaged with the second internal teeth 563 of the second disc body 560.

Therefore, when the actuating component 510 is rotated to force the first disc body 540 and the first baffle plate 41 thereon to rotate about the axis AL of the shaft 530, the first internal teeth 543 of the first disc body 540 rotates the first spur gear 551, the rotation of the first spur gear 551 forces the second spur gear 552 to rotate, and the rotation of the second spur gear 552 forces the second internal teeth 563 of the second disc body 560 to rotate about the axis AL of the shaft 530, such that the second baffle plate 42 that is connected to the second disc body 560 is rotated about the axis AL of the shaft 530 in a direction opposite to that the first baffle plate 41 rotates, thereby changing the angle θ between the first baffle plate 41 and the second baffle plate 42 to enlarge or reduce the range of the sound pressure adjustment area SPA, i.e., achieving the operation shown in FIG. 6.

Figure 10:
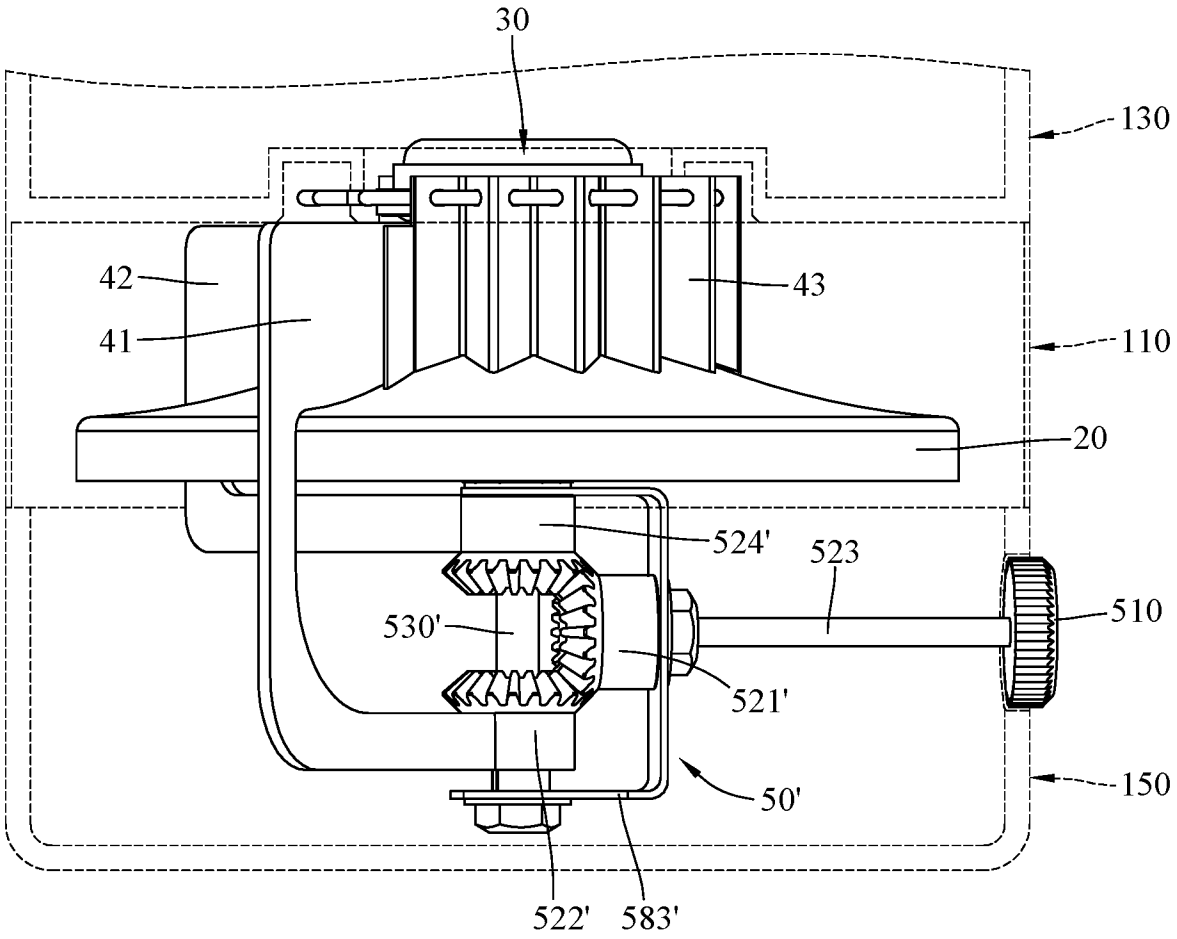
FIG. 10 is a partial enlarged side view of a loudspeaker according to another embodiment of the disclosure.

However, the actuating mechanism 50 in the previous embodiments are exemplary for actuating the directivity adjustment assembly 40, and the disclosure is not limited thereto. For another example, referring to FIG. 10, where FIG. 10 is a partial enlarged side view of a loudspeaker 1' according to another embodiment of the disclosure. Note that the main difference between the loudspeaker 1' of this embodiment and the loudspeaker 1 in the previous embodiments is the design of the actuating mechanism, thus only the differences between these embodiments will be illustrated hereinafter, and the same or similar descriptions may not be repeated and can be obtained with reference to the aforementioned embodiments. Also, in FIG. 10, the parts the same or similar to that of the previous embodiments are designated by the same or similar reference characters or numbers.

In this embodiment, the loudspeaker 1' includes an actuating mechanism 50', the actuating mechanism 50' may include a first bevel gear 521', a second bevel gear 522', a third bevel gear 524', a shaft 530', and a bevel gear bracket 583'. The shaft 530' is fixed in the base case 150, the bevel gear bracket 583' is fixed on the shaft 530'. The first bevel gear 521' is rotatably disposed on the bevel gear bracket 583'. The second bevel gear 522' and the third bevel gear 524' are sleeved on the shaft 530' and spaced apart from each other by a given distance, and the second bevel gear 522' and the third bevel gear 524' are respectively engaged with different sides of the first bevel gear 521'. Note that the second bevel gear 522' and the third bevel gear 524' are rotatable with respect to the shaft 530', and the first baffle plate 41 and the second baffle plate 42 are respectively connected to the second bevel gear 522' and the third bevel gear 524'.

In this arrangement, as the actuating component 510 is rotated, the actuating component 510 rotates the first bevel gear 521' through the transmission bar 523, and the rotation of the first bevel gear 521' simultaneously rotates the second bevel gear 522' and the third bevel gear 524' so as to simultaneously force the first baffle plate 41 and the second baffle plate 42 to pivot about the shaft 530', achieving the purpose of changing the angle between the first baffle plate 41 and the second baffle plate 42.

Figure 11:
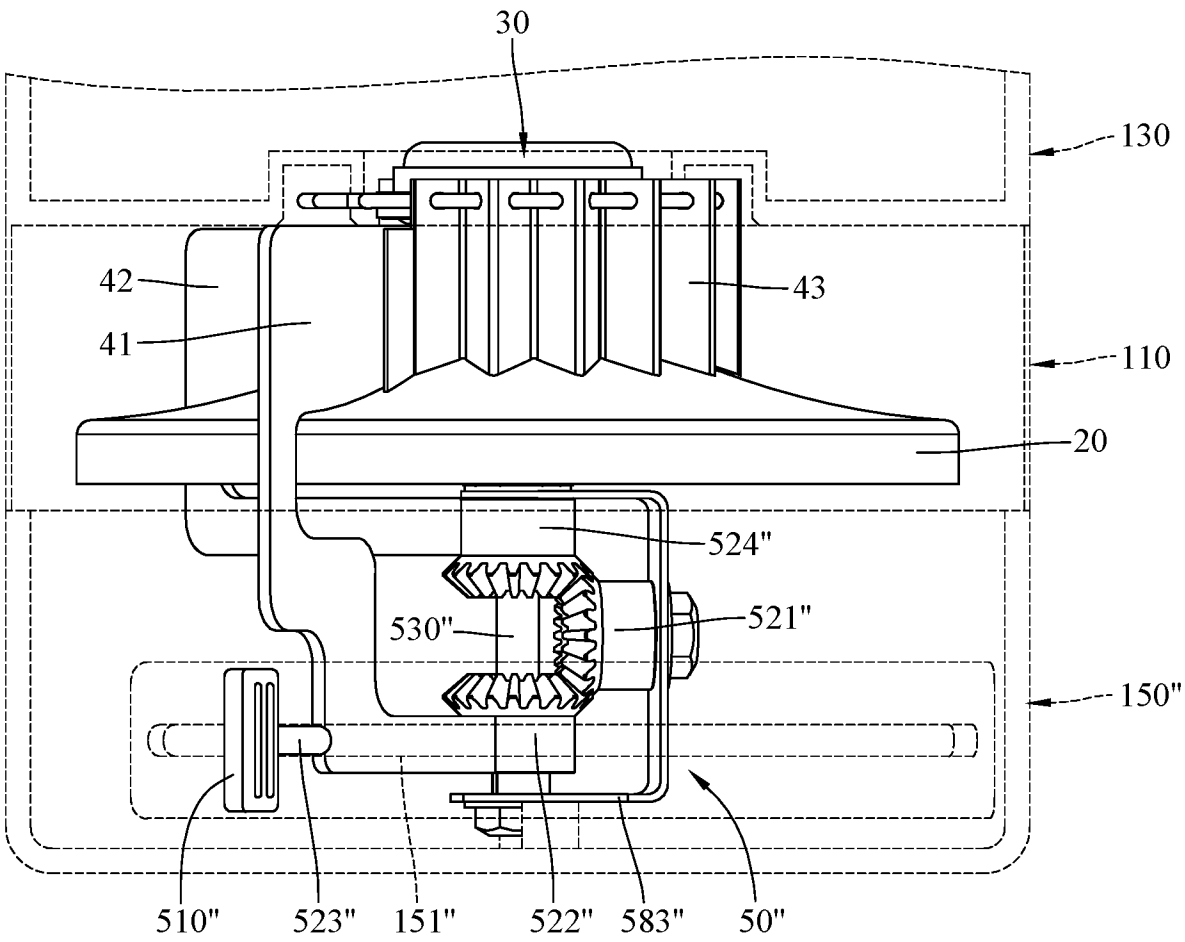
FIG. 11 is a partial enlarged side view of a loudspeaker according to still another embodiment of the disclosure.

Alternatively, referring to FIG. 11, where FIG. 11 is a partial enlarged side view of a loudspeaker 1 "according to still another embodiment of the disclosure. Note that the main difference between the loudspeaker 1" of this embodiment and the loudspeaker 1' in the previous embodiment is the design of the actuating mechanism, thus only the differences between these embodiments will be illustrated hereinafter, and the same or similar descriptions may not be repeated and can be obtained with reference to the aforementioned embodiments. Also, in FIG. 11, the parts the same or similar to that of the previous embodiments are designated by the same or similar reference characters or numbers.

In this embodiment, the loudspeaker 1" includes an actuating mechanism 50" and a base case 150", the actuating mechanism 50" may include an actuating component 510", a first bevel gear 521", a second bevel gear 522", a transmission bar 523", a third bevel gear 524", a shaft 530", and a bevel gear bracket 583".

The shaft 530" is fixed in place in the base case 150", and the bevel gear bracket 583" is fixed on the shaft 530". The first bevel gear 521" is rotatably disposed on the bevel gear bracket 583". The second bevel gear 522" and the third bevel gear 524" are sleeved on the shaft 530" and spaced apart from each other by a given distance, and the second bevel gear 522" and the third bevel gear 524" are respectively engaged with different sides of the first bevel gear 521". Note that the second bevel gear 522" and the third bevel gear 524" are rotatable with respect to the shaft 530", and the first baffle plate 41 and the second baffle plate 42 are respectively connected to the second bevel gear 522" and the third bevel gear 524". The actuating component 510" is connected to the first baffle plate 41 via the transmission bar 523". As such, the user is allowed to pivot the first baffle plate 41 by directly operating the actuating component 510". Correspondingly, the base case 150" may have a groove 150" for the insertion and slidable movement of the transmission bar 523".

In this arrangement, as the actuating component 510" is moved along the groove 150", the actuating component 510" directly pivots the first baffle plate 41 and rotates the second bevel gear 522", the rotation of the second bevel gear 522" rotates the first bevel gear 521", and the rotation of the first bevel gear 521" rotates the third bevel gear 524" so as to pivot the second baffle plate 42. As such, the purpose of changing the angle between the first baffle plate 41 and the second baffle plate 42 is achieved. Note that the actuating component 510" is not restricted to be directly connected to the first baffle plate 41; in one embodiment, the actuating component 510" may be directly connected to the second baffle plate 42, in such a case, the movement of the actuating component 510" can directly pivots the second baffle plate 42 so as to pivot the first baffle plate 41.

In the previous embodiments, the actuating mechanisms can be operated in a way of being manually rotated or pushed in a given direction, but the disclosure is not limited thereto. In some other embodiments, the actuating mechanism can be electrically triggered, correspondingly, the loudspeaker may require motor, antenna and/or other suitable components for the user to remotely control the actuating mechanism via, for example, smartphone or remoter controller; in such a case, the actuating component of the actuating mechanism that is exposed from the outer surface and the hole for the actuating component both can be omitted, such that the appearance of the loudspeaker may feature simpler forms and detailing.

In addition, the first and second baffle plates are hidden in the loudspeaker, in some other embodiments, the outer edges of the first and second baffle plate may be coated with fluorescent pigment or added with light-emitting element so that the edges of the first and second baffle plates can emit light permeable through the housing, allowing the user to recognize the positions of the first and second baffle plates from the appearance of the loudspeaker to acknowledge the status of the directivity of the loudspeaker.

Figure 12:
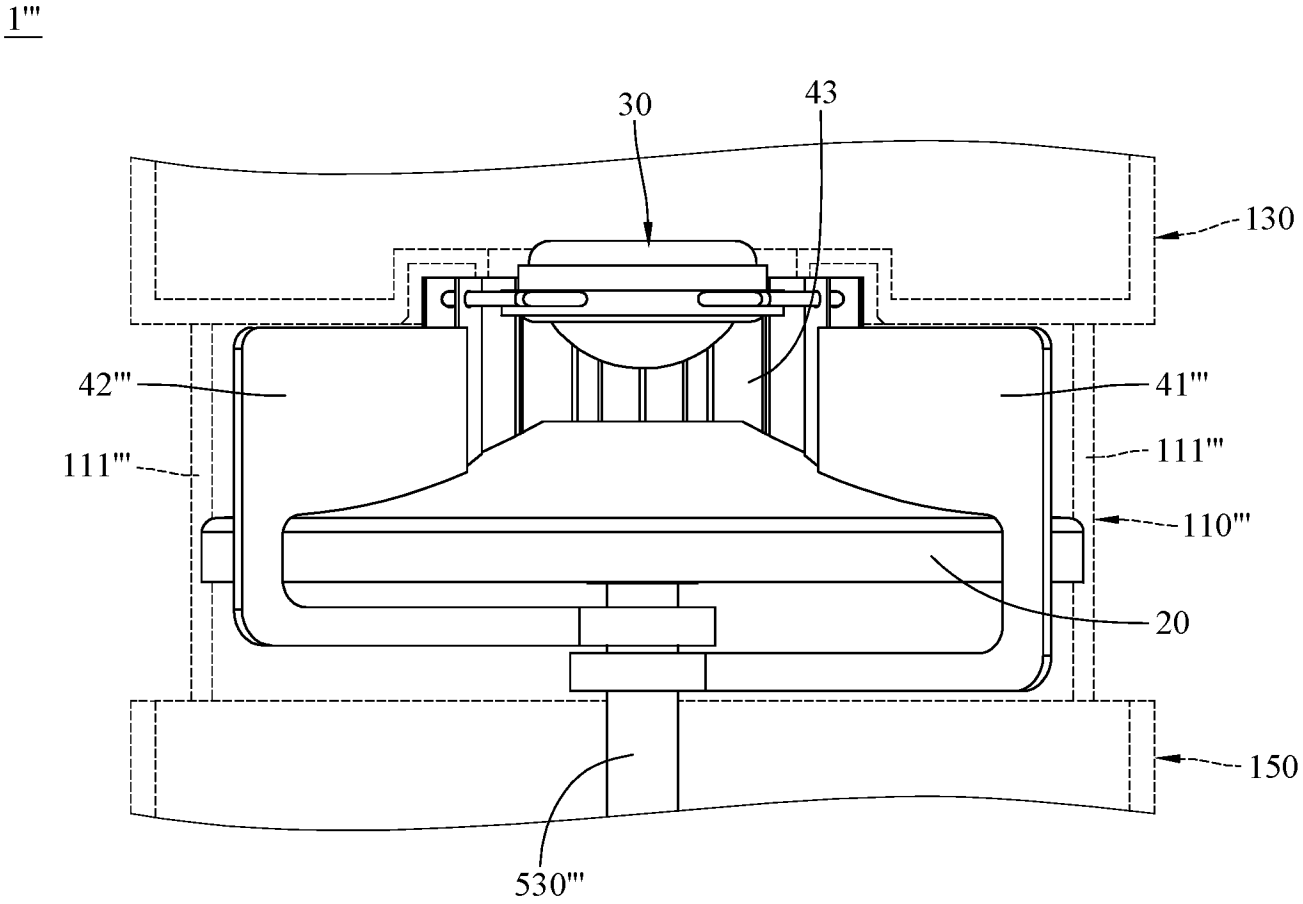
FIG. 12 is a partial enlarged side view of a loudspeaker according to yet another embodiment of the disclosure.

Further, note that the disclosure is not limited by the aforementioned actuating mechanisms. In some other embodiments, the actuating mechanism may be omitted from the loudspeaker, and the first baffle plate or the second baffle plate may be directly manually adjusted to the desired position to adjust the directivity. For example, referring to FIG. 12, where FIG. 12 is a partial enlarged side view of a loudspeaker 1''' according to yet another embodiment of the disclosure. Note that the main difference between the loudspeaker 1''' of this embodiment and the loudspeakers in the previous embodiments is that the loudspeaker 1''' does not have the actuating mechanism, thus only the differences between these embodiments will be illustrated hereinafter, and the same or similar descriptions may not be repeated and can be obtained with reference to the aforementioned embodiments. Also, in FIG. 12, the parts the same or similar to that of the previous embodiments are designated by the same or similar reference characters or numbers.

In this embodiment, the loudspeaker 1''' includes a first baffle plate 41''' and a second baffle plate 42''' that are both rotatably connected to a shaft 530''' fixed at a side of the cone 20, and the sound output case 110''' is in a form of a plurality of support posts 111''' that are separated from each other to make an accommodation space AS''' of the sound output case 110''' an open space. In this arrangement, the user is allowed to touch and directly pivot the first baffle plate 41''' and/or the second baffle plate 42''' to change the angle between the first baffle plate 41''' and the second baffle plate 42''', thereby adjusting the directivity of the loudspeaker 1'''.

According to the sound propagating device and the loudspeaker having the sound propagating device as discussed in the above embodiments of the disclosure, since the first baffle plate, the second baffle plate, and the baffle assembly are moveably located on the conical surface, and the angle between the first baffle plate and the second baffle plate can be changed as at least one of the first baffle plate and the second baffle plate is forced to move, thus, in the application of loudspeaker, the area defined by the baffle assembly and located between the conical surface and the speaker unit can be enlarged or reduced by adjusting the positions of the first baffle plate and/or second baffle plate to adjust the sound pressure of the sound generated from the speaker unit, such that the sound pressure of the sound emitted toward a given direction can be increased, thereby increasing the degree of directivity of the loudspeaker in the given direction. As a result, the user in a specific area can obtain a stronger listening experience.

In addition, in the application of loudspeaker, the conical surface faces toward the speaker unit; therefore, when the first baffle plate and the second baffle plate are pivoted to a suitable position, the sound generated from the speaker unit can be reflected by the cone and propagated evenly in all directions, such that the loudspeaker becomes an omnidirectional loudspeaker and is able to give the same listening experience to every listener in the room.

As such, the sound propagating device and the loudspeaker having the sound propagating device as discussed in the above embodiments of the disclosure can achieve both advantages of the omnidirectional and directional loudspeakers.

It will be apparent to those skilled in the art that various modifications and variations may be made to the present disclosure. It is intended that the specification and examples be considered as exemplary embodiments only, with a scope of the disclosure being indicated by the following claims and their equivalents.

What is claimed is:

1. A loudspeaker, comprising:

a housing;

a speaker unit, located in the housing and having a sound outputting side;

a sound-reflecting component, located in the housing and having a conical surface, wherein the sound outputting side of the speaker unit faces toward the conical surface; and a first baffle plate, a second baffle plate, and a baffle assembly, wherein the first baffle plate and the second baffle plate are respectively connected to two opposite ends of the baffle assembly, and the first baffle plate, the second baffle plate, and the baffle assembly are moveably located on the conical surface;

wherein an angle between the first baffle plate and the second baffle plate is changed when at least one of the first baffle plate and the second baffle plate is moved.

2. The loudspeaker according to claim 1, wherein the baffle assembly comprises a plurality of foldable structures connected in a series.

3. The loudspeaker according to claim 2, further comprising a baffle guiding component, wherein the baffle guiding component is disposed through the plurality of foldable structures.

4. The loudspeaker according to claim 1, wherein at least one of the first baffle plate and the second baffle plate has a bottom edge matching the shape of the conical surface of the sound-reflecting component.

5. The loudspeaker according to claim 1, wherein the housing comprises a resonance chamber case and a sound output case connected to each other, the speaker unit is located at a side of the resonance chamber case facing toward the sound output case, the sound-reflecting component is located in the sound output case, and the first baffle plate, the second baffle plate, and the baffle assembly are located between the resonance chamber case and the conical surface.

6. The loudspeaker according to claim 5, wherein the resonance chamber case, the conical surface of the sound-reflecting component, the first baffle plate, the second baffle plate, and the baffle assembly together define a sound pressure adjustment area therebetween, and the sound outputting side of the speaker unit is located in the sound pressure adjustment area.

7. The loudspeaker according to claim 5, wherein the resonance chamber case has a baffle guiding portion, the baffle guiding portion is located at the side of the resonance chamber case facing toward the sound output case, the baffle guiding portion surrounds the speaker unit, and at least part of the baffle assembly is located in the baffle guiding portion.

8. The loudspeaker according to claim 7, further comprising a baffle guiding component, the baffle assembly comprising a plurality of foldable structures connected in a series, wherein the baffle guiding component is disposed through the plurality of foldable structures and fixed to the baffle guiding portion.

9. The loudspeaker according to claim 1, further comprising a shaft, the shaft having an axis, wherein the first baffle plate and the second baffle plate are pivotably connected to the shaft about the axis.

10. The loudspeaker according to claim 1, further comprising an actuating mechanism disposed on the housing, wherein the actuating mechanism is configured to force at least one of the first baffle plate and the second baffle plate to move so as to change the angle between the first baffle plate and the second baffle plate.

11. The loudspeaker according to claim 10, wherein the actuating mechanism comprises an actuating component, a first bevel gear, a second bevel gear, and a third bevel gear, the second bevel gear and the third bevel gear are sleeved on a shaft and are respectively engaged with different sides of the first bevel gear, the first baffle plate and the second baffle plate are respectively connected to the second bevel gear and the third bevel gear, and the actuating component is connected to the first bevel gear.

12. The loudspeaker according to claim 10, wherein the actuating mechanism comprises an actuating component, a first bevel gear, a second bevel gear, and a third bevel gear, the second bevel gear and the third bevel gear are sleeved on a shaft and are respectively engaged with different sides of the first bevel gear, the first baffle plate and the second baffle plate are respectively connected to the second bevel gear and the third bevel gear, and the actuating component is connected to one of the first baffle plate and the second baffle plate.

13. The loudspeaker according to claim 10, wherein the actuating mechanism comprises an actuating component, a first bevel gear, and a second bevel gear, the actuating component is disposed on the housing and connected to the first bevel gear, the second bevel gear is engaged with the first bevel gear and fixed on a shaft, the first baffle plate is fixed on the shaft, and the second baffle plate is pivotably connected to the shaft.

14. The loudspeaker according to claim 13, wherein the actuating mechanism comprises a first disc body, a second disc body, a first spur gear, and a second spur gear, the first disc body is sleeved on the shaft, the first baffle plate is fixed to the shaft via the first disc body, the second disc body is pivotably sleeved on the shaft and located at a side of the first disc body, the second baffle plate is connected to the second disc body, the first spur gear and the second spur gear are located between the first disc body and the second disc body, wherein the first disc body has a first internal teeth, the second disc body has a second internal teeth, the first spur gear is engaged with the first internal teeth of the first disc body, the second spur gear is engaged with the second internal teeth of the second disc body and the first spur gear.

15. A sound propagating device, comprising:

a sound-reflecting component, having a conical surface; and a first baffle plate, a second baffle plate, and a baffle assembly, wherein the first baffle plate and the second baffle plate are respectively connected to two opposite ends of the baffle assembly, and the first baffle plate, the second baffle plate, and the baffle assembly are moveably located on the conical surface;

wherein an angle between the first baffle plate and the second baffle plate is changed when at least one of the first baffle plate and the second baffle plate is moved.

16. The sound propagating device according to claim 15, wherein the baffle assembly comprises a plurality of foldable structures connected in a series.

17. The sound propagating device according to claim 15, wherein at least one of the first baffle plate and the second baffle plate has a bottom edge matching the shape of the conical surface of the sound-reflecting component.

18. The sound propagating device according to claim 15, further comprising an actuating mechanism configured to force at least one of the first baffle plate and the second baffle plate to move so as to change the angle between the first baffle plate and the second baffle plate.

* * * * *